US005968617A

United States Patent [19]

Jones

[11] Patent Number: 5,968,617

[45] Date of Patent: Oct. 19, 1999

[54] DECORATIVE GLASSWARE AND METHOD OF DECORATING SAME

[76] Inventor: Charles A. Jones, 1224 Barksdale Rd., Lewisville, N.C. 27023

[21] Appl. No.: 08/949,480

[22] Filed: Oct. 14, 1997

[51] Int. Cl.[6] ..... B44F 1/00

[52] U.S. Cl. ..... 428/34.4; 428/79; 428/187; 428/210

[58] Field of Search ..... 428/7, 34.4, 187, 428/210, 13, 79; 156/240

[56] References Cited

U.S. PATENT DOCUMENTS

| | | | |
|---|---|---|---|
| 404,785 | 6/1889 | Gibson | 428/34.4 X |
| 2,265,531 | 12/1941 | Laxer | 156/240 X |
| 2,305,890 | 12/1942 | Moore | 428/34.4 X |
| 3,874,977 | 4/1975 | Pyles | 428/34.4 X |

*Primary Examiner*—Henry F. Epstein

[57] ABSTRACT

A hollow transparent decorated object and a method of decorating a hollow transparent object wherein an elongated cylindrical side wall is simultaneously imprinted with an inner design and an outer design separated by a background substrate. The inner and outer design and the background substrate form a single decal, the background substrate and outer design having aligned openings which in the outer design forms an integral part of the outer design through which a viewer may see the inner design opposite the opening. The method involves applying an inner design and an outer design having an opening between which is positioned a background substrate having an opening aligned with the outer design opening and all forming a single decal. The combined inner design, background substrate and outer design forming the single decal is applied simultaneously to the outside side wall surface so that a viewer may see through the outer design opening, the background substrate opening and the side wall to view the inner design.

6 Claims, 2 Drawing Sheets

DECORATIVE GLASSWARE AND METHOD OF DECORATING SAME

BACKGROUND OF THE INVENTION

1. Field of the Invention

The present invention relates to decorated transparent objects such as glassware and methods of making same and particularly to cylindrical glassware such as tumblers and the like having a design with three dimensional visual perception.

Decorative designs on glassware have been utilized for quite some time. For instance, surfaces of tumblers have been decorated with designs formed in the glass by cutting, sand and shot blasting, etching with suitable compounds and solutions and by painting the surfaces with a variety of paints and other substances. Other processes have been used for accomplishing the decoration of such items.

An interesting application of tumbler decoration is included in U.S. Pat. No. 3,874,977 (Pyles) wherein a pair of separate designs are imprinted around the circumference of a glass cylinder, one on top of the other, and separated from one another by a neutral background and an opening through the outermost design and the neutral background forming an integral part of the outermost design through which a viewer may see the innermost design through the glass wall of the cylinder. The design is accomplished by printing on the circumference of the cylindrical glass object a scene or design in a reversed or mirror image of the scene to be viewed, then direct printing a background or overlay on top of the innermost scene or design and around the circumference except for an opening diametrically opposite the principal area of the innermost design. A second outermost design or scene is directly printed on top of the neutral background or overlay which scene or design incorporates the opening in the background as an integral element of the outermost scene or design. The designs and background are preferably made by using ceramic enamels directly printed on glass which are set by conventional firing methods.

While this prior art object and method have been generally accepted, it has been limited in clarity, detail and color because of the numerous passes that must be made over the surface of the cylinder to apply the various enamels that give extensive color and light to the design. Moreover, the process is expensive, taking quite some time to apply one by one the various colors to the tumbler surface in order to complete the design. Moreover, waste is often excessive in that any one misaligned pass of the application of enamel on the surface of the tumbler will ruin the product even though most of the enamel coats have been previously applied without error.

The concept is an interesting one and opens the market for a multitude of activity if highly credible and attractive designs can be applied to cylindrical glassware through a design that can result in three dimensional visual perception. It is to this need that the present application is directed.

SUMMARY AND OBJECTIVES OF THE INVENTION

The present invention is a new and improved decorated hollow transparent object having an elongated cylindrical sidewall which has a simultaneously imprinted inner design and outer design around the circumference of the side wall. The outer design is superimposed on the inner design and the two are separated by a background substrate to avoid color pass through. The inner and outer designs and the background substrate form a single decal. The background substrate and outer design have aligned openings, and the outer design opening forms an integral part of the outer design through which a viewer may see the inner design opposite the opening.

The method of decorating a hollow transparent object with an elongated cylindrical side wall involves forming a flat single decal by applying an inner design to a decal substrate, a background substrate with an opening over the inner design wherein the opening is positioned diametrically opposite the principal area of the inner design, and an outer design having an opening over the background substrate and inner design wherein the outer design opening coincides with the background substrate opening and forms an integral element of the outer design. The combined inner design, background substrate and outer design decal is then applied to the outside sidewall surface so that a viewer may see through the outer design opening, the background substrate opening and the glass side wall to view the inner design.

From the summary set forth above, it can be seen that a primary objective of the present invention is to provide a new and improved decorated transparent object and a method of forming same which has all of the advantages of prior art objects and methods and none of the disadvantages.

It is another objective of the present invention to provide a decorative cylindrical transparent object having a design with three dimensional visual perception with color integrity and design details heretofore unachieveable.

Yet still another objective of the present invention is to provide a method of decorating hollow transparent objects which is far less expensive and far more reliable and less subject to waste than previously accomplished.

Yet still a further objective of the present invention is to provide a new object and method that is capable of much faster operation and completion than heretofore achievable.

Thus, there has been outlined the more important features of the invention in order that the detailed description that follows may be better understood and in order that the present contribution to the art may be better appreciated. There are, of course, additional features of the invention that will be described hereinafter and which will form the subject matter of the claims appended hereto. In this respect, it is to be understood that the invention is not limited in its application to the details of construction and to the arrangement of the components set forth in the following description or illustrated in the drawings. The invention is capable of other embodiments and of being practiced and carried out in various ways.

It is also to be understood that the phraseology and terminology employed herein are for the purpose of description and should not be regarded as limiting. Those skilled in the art will appreciate that the concept upon which this disclosure is based may be readily utilized as a basis for the designing of other structures, methods and systems for carrying out the several purposes of the present invention. It is important, therefore, that the claims be regarded as including equivalent constructions insofar as they do not depart from the spirit and scope of the present invention.

Thus, the enumerated objectives and others identified hereinafter, along with the various features of novelty which characterize the invention, are pointed out with particularity in the claims annexed hereto and forming a part of this disclosure. For a better understanding of the invention, its operating advantages and the specific objectives attained by its use, reference is made to the accompanying drawings forming a part of the Specification in which like characters of reference designate like parts throughout the several views.

DETAILED DESCRIPTION OF THE PREFERRED EMBODIMENT

Figure 1:
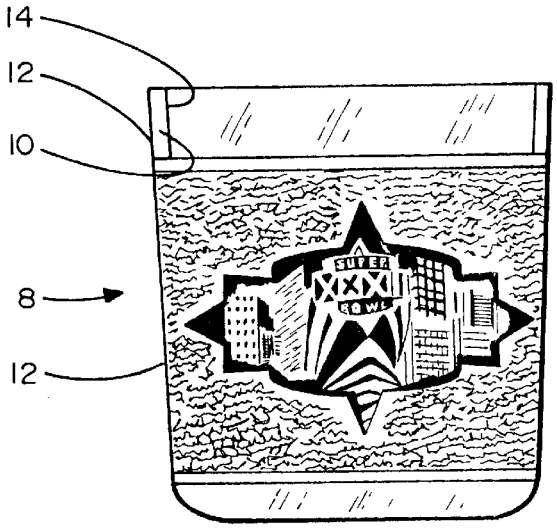
FIG. 1 is a side elevational and schematic view of the decal formed in practicing the method of the present invention applied to the surface of a hollow transparent object.
Figure 3:
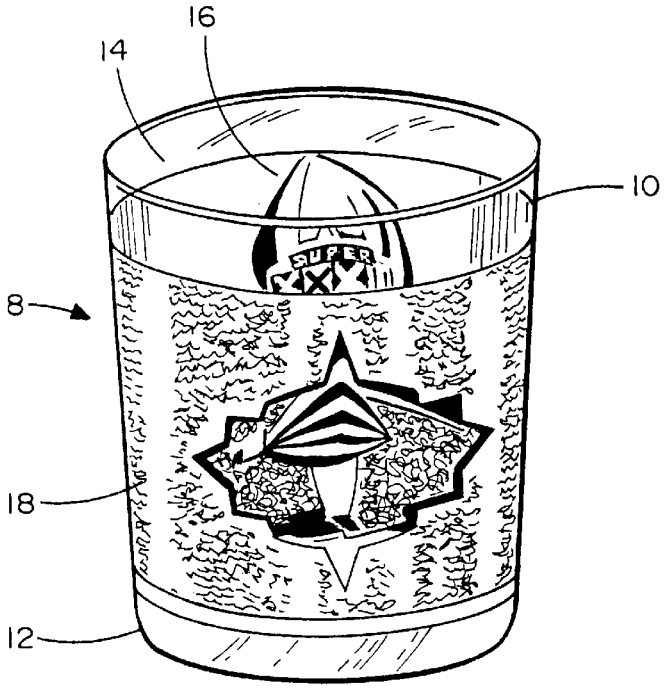
FIG. 3 is an isometric view of the hollow glass object of FIG. 1.
Figure 2:
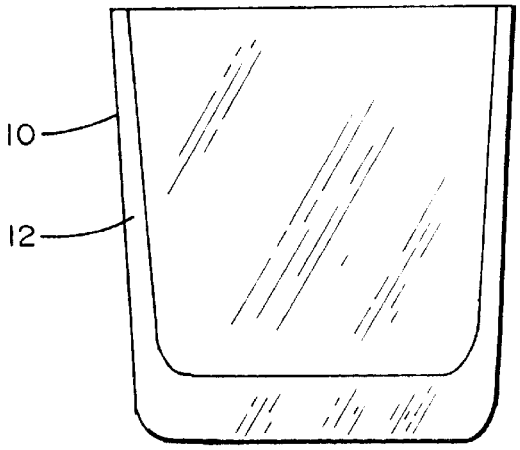
FIG. 2 is a sectional view on a line 2—2 of FIG. 1.
Figure 5:
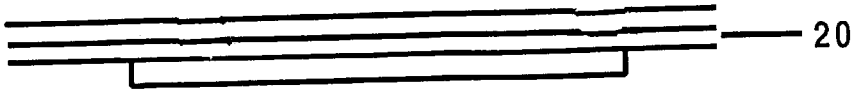
FIG. 5 is an enlarged sectional view of the decal shown in FIG. 4.
Figure 4:
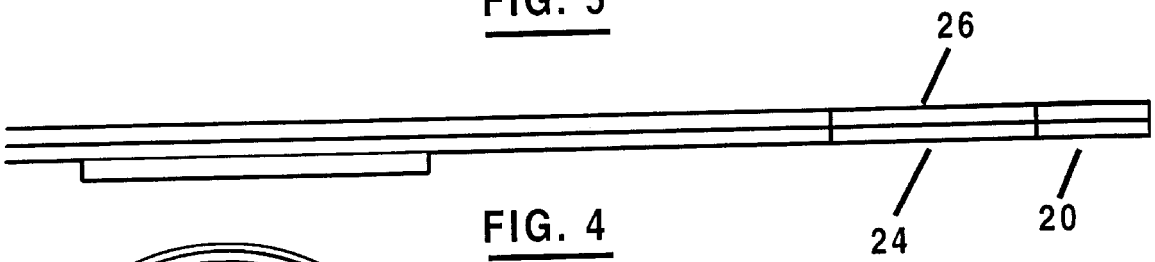
FIG. 4 is a top plan view of an inner design, a background substrate, and an outer design bonded together to form a single decal.
Figure 6:
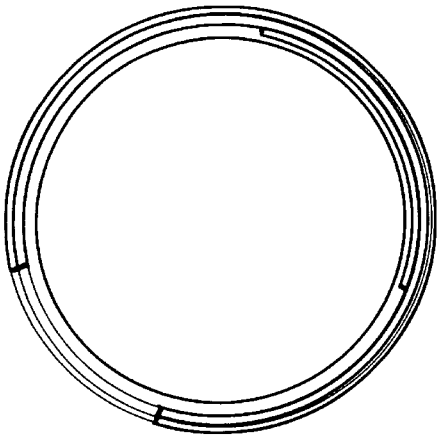
FIG. 6 is a plan view of a transparent object to which has been applied the decal shown in FIGS. 4 and 5.
Figure 7:
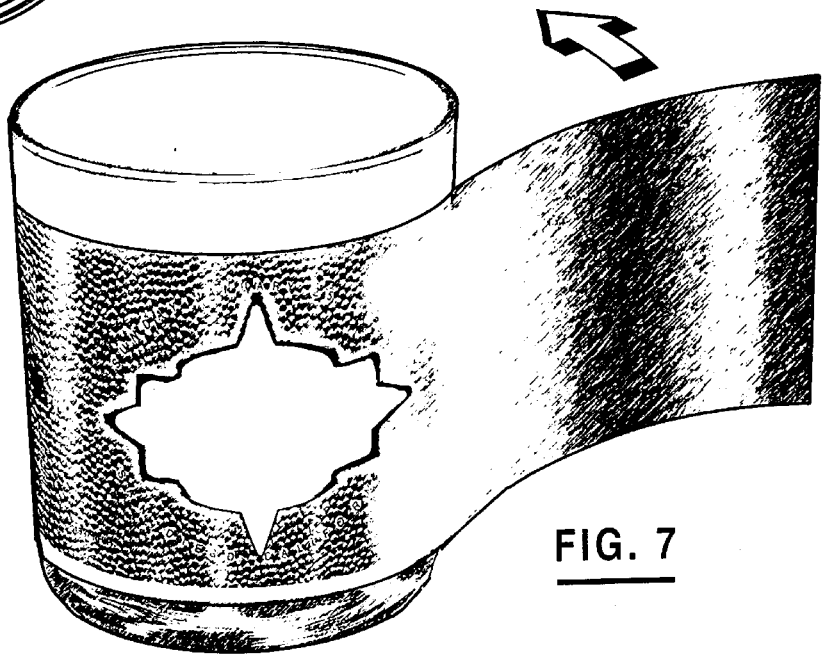
FIG. 7 is a perspective view of the decal of FIG. 4 being applied to the surface of a glass.

Referring now to the drawings, and particularly to FIG. 1, a transparent cylindrical object such as a glass shown generally as 8 having a cylindrical side wall 10 with an outside side wall surface 12 and an inside side wall surface 14 is decorated with ceramic enamels by the creation and application of single decal in a manner to be described. Glass 8 has an inner design 16 and an outer design 18 with inner and outer designs 16, 18 being separated a non-transparent background substrate 20. Background substrate 20 and outer design 18 have openings 24, 26, and outer design opening 26 forms an integral part of the outer design 18 through which a viewer may see the inner design 16. Background substrate opening 24 with outer opening 26 provides an open window in the design which, upon viewing through, reveals a different design 16 through the inside of the glass. The design on the inside is printed in a reversed or mirror image of the scene to be viewed.

The method of decorating glass 8 includes developing a single substantially flat decal by applying an inside design by silk screening in four color or spot color process on decal paper or substrate with the undersigned image printed first in reverse. Reverse, in that sense, is that the image and the order of color printing the image is reversed in comparison to the normal four color process printing described subsequently.

Background substrate 20 having an opening over the inner design positioned diametrically opposite the principal area of the first design is then applied to prevent color pass through from the first and second design to each other.

Outer design 18 is overprinted over background substrate 20 and inner design 16 wherein the outer design opening 26 coincides with background substrate opening 24 and forms an integral element of outer design 18. Outer design 18 is formed with a regular four color process in normal order of white. Once the colors are printed and dried, the image is transferred to the product.

The formed single decal, made up of combined inner design 16, background substrate 20 and outer design 18, is applied to the outside side wall surface by sliding the decal off the decal paper or substrate onto the outside side wall surface. The glass applied decal is then fired. The resulting product enables the viewer to see through outer design 18 and background substrate opening 24 and onto the glass side wall to view the inner design 16 in a three dimensional visual perception.

The method of the present invention permits the decoration of a glass object such as a glass in a highly unique and efficient manner. In prior art glass decorations of this nature, color layer after color layer is directly applied to the surface of the glass to complete the printing process so that printing was always against the arcuate surface of the tumbler. Alignment of the tumbler with the printing press is always critical in this situation and up to 3 or 10 passes must be made against the glass surface with various colors and substances to complete the decoration process. Application with consistent pressure and alignment is always difficult on a curved surface, and waste is sometimes exceptionally high. The time involved in preparing each glass can be wasted if the final stage or a near final stage is misapplied after the first two to six stages have been accurately applied. Moreover, the passing of the glass against the printer elements for each individual color layer necessarily takes an inordinate amount of time by comparison with the present invention.

The present invention represents a significant step forward in glass decorating efficiency and integrity by enabling the preparation of the decal on a flat surface which is easily managed from an alignment perspective and easily applied with additional colors to enhance the integrity and appearance of the design. Thus, a much higher degree of quality is achieved by the present technique than is attainable in prior art methods. For example, the dots per inch achievable on a curved glass surface through the method shown in U.S. Pat. No. 3,874,977 is much less than the layered single decal of the present invention which can contain a range of from 185 to 200 dots per inch and thus provide much more attractive and detailed designs.

The object and method for forming same comprising the invention has been illustrated and described in operable form. It is to be realized that optimum dimensional relationships for the parts of the invention to include variations in size, materials, shape, form, function and manner of operation, assembly and use are deemed readily apparent and obvious to one skilled in the art. All equivalent relationships to those illustrated in the drawings and described in the Specification are intended to be encompassed herein. The foregoing is considered as illustrative only of the principals of the invention. Numerous modifications and changes will readily occur to those skilled in the art, and it is not desired to limit the invention to the exact construction and operation shown and described. All suitable modifications and equivalents that fall with the scope of the appended claims are deemed within the present inventive concept.

What is claimed is:

1. A method of decorating a hollow transparent object having an elongated cylindrical side wall with an inside side wall surface and an outside side wall surface comprising the steps of: printing an inner design on a decal substrate; printing a background substrate having an opening over the inner design wherein the opening is positioned diametrically opposite the principal area of the inner first design; overprinting an outer design having an opening over the background substrate and inner design to cover the background substrate and inner design and form a single decal wherein the outer design opening coincides with the background substrate opening and forms an integral element of the outer design; removing the single decal formed from the combined inner design, background substrate and outer design from the decal substrate and applying the single decal to the outside side wall surface so that a viewer may see through the outer design opening, the background substrate opening and the glass side walls to view the inner design.

2. The method as claimed in claim 1 wherein the first design is a mirror image as seen through the backgrounds and second design openings.

3. The method as claimed in claim 2 wherein the first design, backgrounds and second design are of fired ceramic enamels.

4. The method as claimed in claim 3 wherein the second design opening and backgrounds opening are diametrically opposed to a principal theme of the first design.

5. The method of claim 1 wherein the first design, backgrounds and second design are of fired ceramic enamels.

6. The method as claimed in claim 1 wherein the second design opening and backgrounds opening are diametrically opposed to a principal theme of the first design.

* * * * *